US008375909B2

(12) United States Patent
Radulescu et al.

(10) Patent No.: US 8,375,909 B2
(45) Date of Patent: Feb. 19, 2013

(54) ROCKER ARM RETENTION

(75) Inventors: Andrei D. Radulescu, Marshall, MI (US); James R. Sheren, Grand Ledge, MI (US); Brian K. Vandeusen, Augusta, MI (US)

(73) Assignee: Eaton Corporation, Cleveland, OH (US)

( * ) Notice: Subject to any disclaimer, the term of this patent is extended or adjusted under 35 U.S.C. 154(b) by 339 days.

(21) Appl. No.: 12/363,153

(22) Filed: Jan. 30, 2009

(65) Prior Publication Data

US 2010/0192889 A1 Aug. 5, 2010

(51) Int. Cl.
*F01L 1/18* (2006.01)

(52) U.S. Cl. ..... 123/90.39; 123/90.16; 123/90.52

(58) Field of Classification Search ..... 123/90.52, 123/90.55, 90.16, 90.39
See application file for complete search history.

(56) References Cited

U.S. PATENT DOCUMENTS

| | | | | |
|---|---|---|---|---|
| 4,481,913 | A | 11/1984 | Wirth | |
| 4,807,576 | A | 2/1989 | Sonoda et al. | |
| 4,942,854 | A | 7/1990 | Shirai et al. | |
| 5,584,267 | A | 12/1996 | Muir | |
| 5,680,838 | A | 10/1997 | See et al. | |
| 6,382,150 | B1 | 5/2002 | Fischer | |
| 2007/0204818 | A1 * | 9/2007 | Dingle | 123/90.16 |
| 2009/0145388 | A1 * | 6/2009 | Hiramatsu | 123/90.39 |

FOREIGN PATENT DOCUMENTS

| | | |
|---|---|---|
| DE | 19522720 | 1/1996 |
| DE | 19652676 | 6/1998 |
| DE | 19717981 | 10/1998 |
| DE | 19838909 | 3/2000 |
| DE | 19927929 | 1/2001 |
| DE | 19956159 | 5/2001 |
| DE | 29924858 | 5/2006 |
| DE | 102006004585 | 8/2007 |
| EP | 0634564 | 1/1995 |
| EP | 1493902 | 1/2005 |
| EP | 2067943 | 6/2009 |
| WO | WO-0020730 | 4/2000 |
| WO | WO-2004038185 | 5/2004 |
| WO | WO-2004038186 | 5/2004 |

OTHER PUBLICATIONS

European Search Report dated May 17, 2010 (2 pages).
Espacenet English Abstract for DE19717981A1 (1 page).
Espacenet English Abstract for DE29924858U1 (1 page).
Espacenet English Abstract for EP1493902A1 (1 page).
Espacenet English Abstract for DE19927929A1 (1 page).
Espacenet English Abstract for EP0634564A1 (1 page).
Espacenet English Abstract for DE19838909A1 (1 page).
English abstract for DE-19956159.
English abstract for DE-102006004585.

* cited by examiner

*Primary Examiner* — Zelalem Eshete
(74) *Attorney, Agent, or Firm* — Rader, Fishman & Grauer PLLC

(57) ABSTRACT

A reciprocating lever for a valve train assembly is provided, including a receiving portion and at least one retaining feature. The receiving portion is for selectively receiving a member that is actuated by the reciprocating lever. An actuation direction is also included and is defined by an actuation axis, wherein the reciprocating lever selectively actuates the member. The at least one retaining feature is located at the receiving portion of the reciprocating lever. The at least one retaining feature is configured to selectively engage with and limit relative movement of the member with respect to the reciprocating lever along the actuation axis.

21 Claims, 4 Drawing Sheets

ROCKER ARM RETENTION

TECHNICAL FIELD

The present disclosure relates to a reciprocating lever for a valve train assembly, and in particular to a reciprocating lever including at least one retaining feature.

BACKGROUND

An overhead cam valve train system may include a cam, valve, hydraulic lash adjuster and a rocker arm. The rocker arm, which may be also called the roller finger follower, may include a bearing or slider pad contacting the cam. The rocker arm may also include a surface in contact with the valve, as well as a surface that is in contact with a ball plunger of the hydraulic lash adjuster. As the cam rotates, the rocker arm may translate the circular motion from the cam into linear motion, where the linear motion may be communicated to the hydraulic lash adjuster and the valve. The valve may be actuated in a linear motion in an effort to allow air in and out of a cylinder. A compression spring may be added to the valve to keep the rocker arm in permanent contact with the valve, cam, and hydraulic lash adjuster.

Some types of valve train systems may be used in high powered multi-cylinder internal combustion engines. High powered engines may be used in applications where quick acceleration or heavy towing capacity is needed. However, if the high powered engine is used in an application requiring less power, the extra output from the engine may be wasted. To improve efficiency and reduce waste, these high powered engines may be designed to include cylinder deactivation, where less than all of the cylinders may be activated in at least some lower power operating conditions. During cylinder deactivation, fuel and air may not be delivered to some of the cylinders. In one approach, air may be suppressed to an inactive cylinder by closing the valve corresponding with the inactive cylinder. This may be accomplished by including a type of partially collapsible hydraulic lash adjuster with the inactive cylinder, where the collapsible hydraulic lash adjuster may absorb the linear motion of the rocker arm. That is, during cylinder deactivation the collapsible hydraulic lash adjuster may absorb the linear movement of the rocker arm, and as a result the valve will remain closed.

In some situations, the rocker arm may disengage from the ball plunger of the hydraulic lash adjuster during cylinder deactivation, which may cause damage to the valve train system. There are several approaches that may be used to limit separation between the ball plunger of the hydraulic lash adjuster and the rocker arm. In one approach, a clip is added to the hydraulic lash adjuster. The clip may engage with the ball plunger of the hydraulic lash adjuster, Because the clip is a separate part, there may be extra cost associated with adding the clip to the existing rocker arm. In another approach, the rocker and the hydraulic lash adjuster are secured together with a pin. The pin may be inserted through both the ball plunger of the hydraulic lash adjuster and the rocker arm. Like the clip approach, because the pin is a separate part, there may be extra cost associated with adding the pin to the existing hydraulic lash adjuster and rocker arm assembly. Moreover, there may be issues concerning service, packaging or robustness of the design that may make the pin approach less desirable.

Therefore, there exists a need to provide a robust and cost effective retention device between the hydraulic lash adjuster and the rocker arm to retain the ball plunger within the rocker arm.

DETAILED DESCRIPTION

Figure 1:
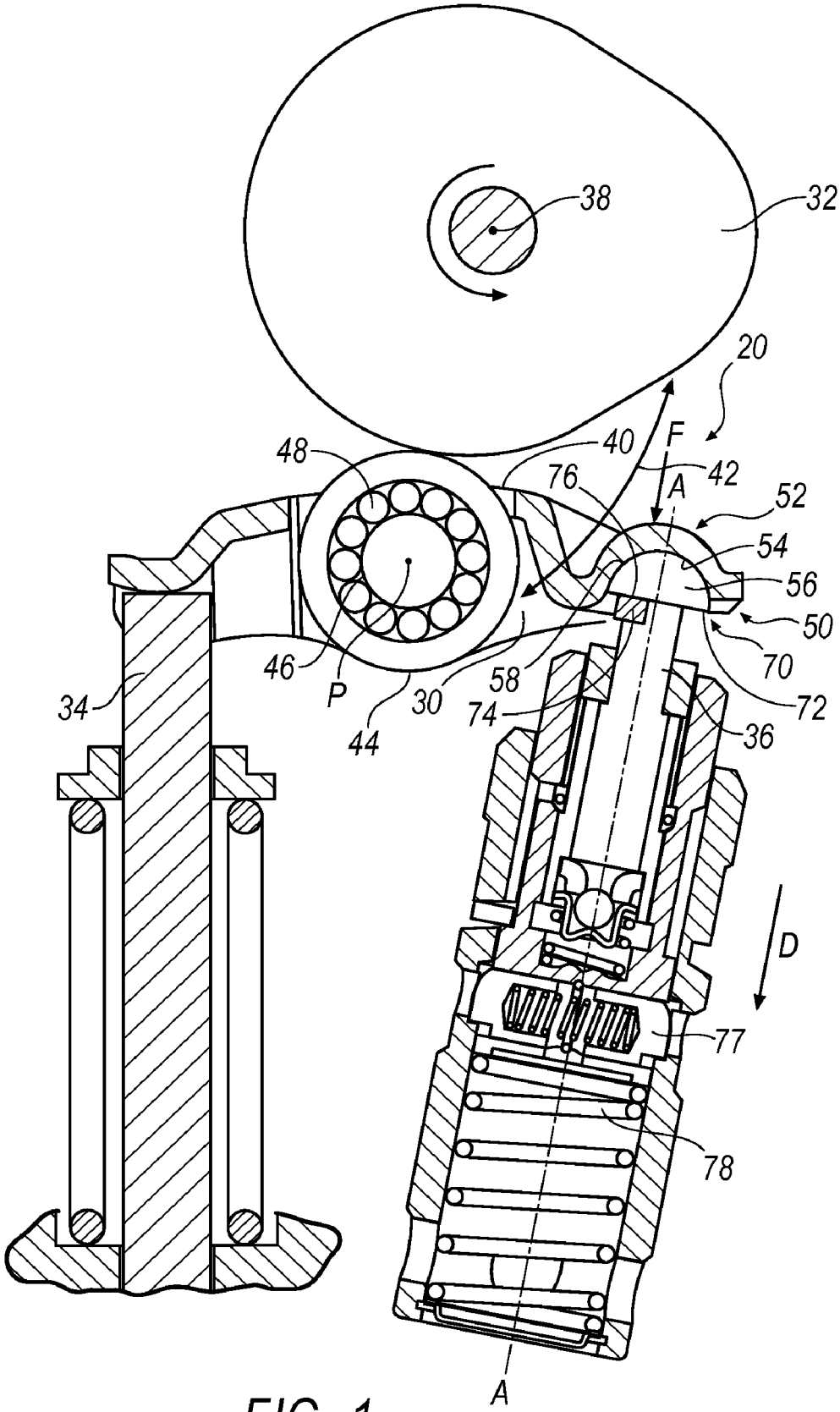
FIG. 1 is a partial cross sectional view of a valve train system including a cam, a rocker arm and a hydraulic lash adjuster.

Referring now to the discussion that follows and also to the drawings, illustrative approaches to the disclosed systems and methods are shown in detail. Although the drawings represent some possible approaches, the drawings are not necessarily to scale and certain features may be exaggerated, removed, or partially sectioned to better illustrate and explain the present disclosure. Further, the descriptions set forth herein are not intended to be exhaustive or otherwise limit or restrict the claims to the precise forms and configurations shown in the drawings and disclosed in the following detailed description.

Moreover, a number of constants may be introduced in the discussion that follows. In some cases illustrative values of the constants are provided. In other cases, no specific values are given. The values of the constants will depend on characteristics of the associated hardware and the interrelationship of such characteristics with one another as well as environmental conditions and the operational conditions associated with the disclosed system.

FIG. 1 illustrates an exemplary valve train system 20. Although FIG. 1 illustrates the valve train 20 in an overhead cam configuration of an engine, it should be noted that the valve train system 20 may be included any type of engine configuration, such as, for example, an engine including a cam shaft located within the engine block. The valve train 20 may include a rocker arm 30 that may be a reciprocating lever conveying radial movement from a valve actuating cam 32 into generally linear movement. In particular, the rocker arm 30 may engage with and communicate linear movement to an actuation member 36. In one illustration, the actuation member 36 may be a deactivating hydraulic lash adjuster including a ball plunger 56.

The rocker arm 30 may include at least one retaining feature 74 illustrated as a tab for selectively limiting the separation or relative movement between the rocker arm 30 and the actuation member 36. More specifically, the retaining feature 74 may be selectively engaged with a shoulder 70 of the ball plunger 56 of the actuation member 36, thereby securely positioning the actuation member 36 within the rocker arm 30. The valve train system 20 may be different from at least some other types of valve train systems because a retention assembly may be created between the retaining features 74 of the rocker arm 30 and the shoulder 70 of the actuation member 36. The retention assembly may selectively limit relative movement between the rocker arm 30 and the actuation member 36 in a downward direction, away from the rocker arm 30.

The valve train system 20 in FIG. 1 includes the rocker arm 30, a valve actuating cam 32, a valve 34, and the actuation member 36. The cam 32 may be in radial communication with an outer surface 40 of the rocker arm 30, at a roller bearing 44 of the rocker arm 30. The cam 32 may be rotated about a camshaft 38, where the cam 32 communicates radial movement to the rocker arm 30. The rocker arm 30 may be any reciprocating lever for translating radial movement of the cam 32 into generally linear movement. The rocker arm 30 may then communicate the generally linear movement to both of the actuation member 36 and the valve 34. FIG. 1 is an exemplary illustration of the valve train system 20 utilized in an overhead valve train configuration, where the cam 32 is an overhead cam that operates above the valve 34 and the actuation member 36.

As the cam 32 rotates about the cam shaft 38, the rocker arm 30 may be selectively rotated about a pivot axis P-P, where the pivot axis P-P may be located at the roller bearing 44 of the rocker arm 30. In particular, the rocker arm 30 may be actuated by the cam 32 along a line of action 42. As the cam 32 rotates, the rocker arm 30 selectively exerts a force F on the actuation member 36, causing the actuation member 36 to be moved along an actuation direction that may be generally longitudinal and defined by an actuation axis A-A.

The valve train system 20 may be part of an engine that includes cylinder deactivation, where less than all of the cylinders may be activated in at least some operating conditions in an effort to promote fuel economy. That is, the rocker arm 30 may be selectively operable between an active mode where the rocker arm 30 is operable to selectively actuate the actuation member 36 and the valve 34, and an inactive mode where the motion from the cam 32 to the valve 34 is suppressed by the actuation member 36. When the rocker arm 30 is in the inactive mode, rotational movement from the cam 32 may not be translated to the valve 34. More specifically, the force F exerted along the actuation axis A-A from the rocker arm 30 to the actuation member 36 may be suppressed, where two latch pins 77 located within the actuation member 36 may limit motion along the actuation axis A-A. It should be noted that the rocker arm 30 and the actuation member 36 may also be used in non-deactivation type engines as well.

In one exemplary illustration, the rocker arm 30 may be a rocker finger follower type of rocker arm including an axle 46 and the roller bearing 44. At the center of the rocker finger follower is the axle 46. The axle 46 may be a cylinder including a smooth outer finish to serve as the center, or point of rotation, for the rocker arm 30, and may include the pivot axis P-P. The roller bearing 44 may be located around the axle 46, and includes a set of needles or ball bearings 48. It is understood that while FIG. 1 illustrates a rocker finger follower as the rocker arm 30, other types of rocker arms may be used as well, such as, for example, shaft-mount rocker arms, or rocker arms that include sliding pads instead of roller bearings.

The rocker arm 30 includes an inner portion 50. The inner portion 50 includes a receiving portion 52, where the receiving portion 52 of the rocker arm 30 selectively engages with the actuation member 36. FIG. 1 illustrates the receiving portion 52 as a recess 54 that receives the ball plunger 56 of the actuation member 36. In particular, the recess 54 may include a generally hemispherical surface that substantially coincides with the outer surface 58 of the ball plunger 56. Although FIG. 1 illustrates the actuation member 36 with a hemispherical outer surface 58, it is understood that the outer surface 58 may include other configurations as well. For example, the outer surface 58 of the ball plunger 56 may be parabolic, and the recess 54 may substantially coincide with the parabolic outer surface 58.

Figure 2:
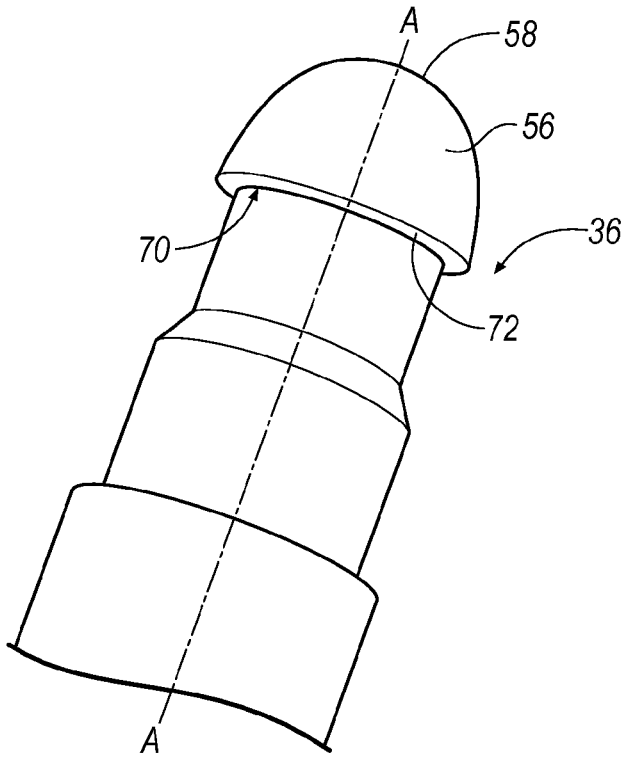
FIG. 2 is an enlarged view of the hydraulic lash adjuster in FIG. 1, including a ball plunger with a cut to create a shoulder.

In one exemplary illustration, the actuation member 36 may be a hydraulic lash adjuster including the ball plunger 56, however it is understood that the actuation member 36 may also be any component selectively actuated by the rocker arm 30. For example, in one illustration the actuation member 36 may be a push rod. In another illustration, the hydraulic lash adjuster may be of the collapsible type. The ball plunger 56 of the actuation member 36 may also include the shoulder 70. Turning to FIG. 2, the shoulder 70 may be a cut that is located along the outer surface 58. In one example the shoulder 70 may be a generally annular cut that circumscribes around the entire outer surface 58. Alternatively, the shoulder 70 may only extend around a portion of the outer surface 58. The shoulder 70 includes a contact surface 72, which contacts a retaining feature of the rocker arm 30.

Figure 3:
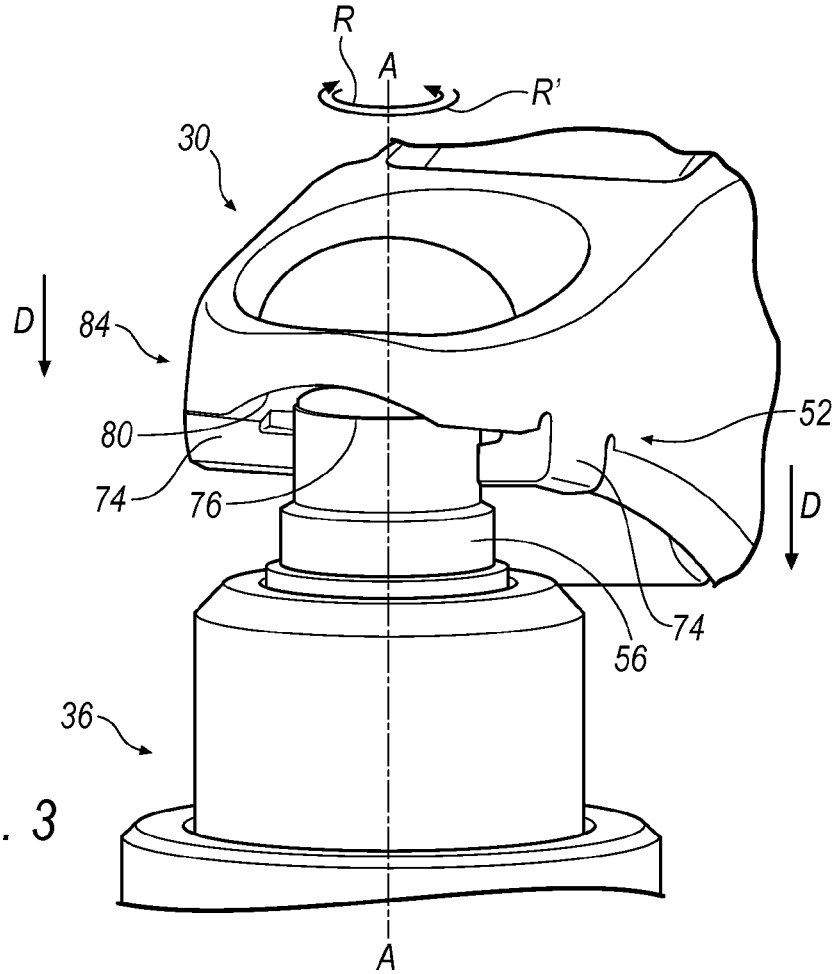
FIG. 3 is an elevational view of the hydraulic lash adjuster in engagement with the rocker arm.

FIG. 3 is an elevational view of the rocker arm 30 assembled to the actuation member 36. The rocker arm 30 includes at least one retaining feature 74 at the receiving portion 52, where the retaining feature may be at least one tab that may project radially inwardly towards the actuation axis A-A. The retaining features 74 may be in contact with the contact surface 72 of the shoulder 70 of the ball plunger 56, and selectively limit relative movement along the actuation axis A-A between the rocker arm 30 and the actuation member 36. In particular, the retaining features 74 may selectively limit relative movement in a downward direction D between the rocker arm 30 and the actuation member 36.

Figure 4:
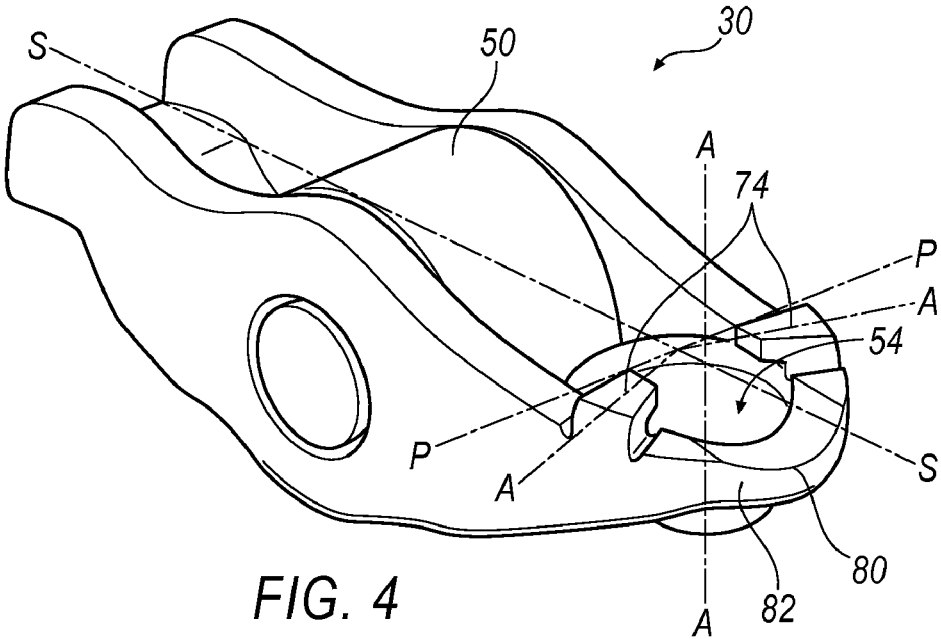
FIG. 4 is an elevational view of an underside of the rocker arm assembly, including two tabs that are positioned on opposing sides of a recess.

FIG. 4 illustrates the inner portion 50 of the rocker arm 30, showing the positioning of the retaining features 74 along the recess 54. In particular, the rocker arm 30 includes two retaining features 74 that are positioned on generally opposing sides of the recess 54. In one exemplary approach, the retaining features 74 may be created integrally with the rocker arm 30 as part of a stamping process. However, the retaining features 74 may also be created, for example, as a separate part as well and then added to the rocker arm 30 by a joining process (e.g., welding).

The retaining features 74 may be positioned sideways at an angle in an effort to maintain a generally constant clearance between the ball plunger 56 (as seen in FIGS. 1-3) and the rocker arm 30 during operation of the valve train system 20. More specifically, an axis of symmetry of the rocker arm 30 may be defined as an axis of symmetry S-S. A line P may also be included, where the line P is generally perpendicular to the axis of symmetry S-S. The retaining features 74 may be positioned at an angle A that is measured in relation to the line P. That is, the retaining features 74 may not be aligned with the line P, and may not be generally perpendicular with the axis of symmetry S-S of the rocker arm 30. However, in another illustrative example the retaining features 74 may be aligned with the line P instead. The retaining features 74 may be positioned around the recess 54 in an effort to reduce the amount of interference during assembly of the rocker arm 30 to the actuation member 36 as well. That is, the retaining features 74 may be positioned at the angle A around the recess 54 such that the retaining features 74 have minimal contact with the ball plunger 56 during assembly (see FIG. 5).

FIG. 4 illustrates the two tabs spaced generally equidistant from one another. Positioning the tabs generally equidistant from another may allow for a substantially uniform distribution of pressure exerted from the shoulder 70 of the ball plunger 56 to the retaining features 74 (see FIG. 3). However it is understood that the two tabs may be positioned at other desired locations. Although only two retaining features 74 are illustrated, it is understood that one, two or more retaining features may be included. Moreover, while FIG. 3 illustrates the retaining feature 74 as a tab, other types of retaining features may be used as well to selectively limit relative movement between the actuation member 36 and the rocker arm 30. In one exemplary illustration, the retaining feature 74 may be a flange, where the flange may circumscribe at least a portion of the recess 54. That is, the retaining feature 74 may be a single, unitary tab that is created as a flange.

Turning back to FIG. 1, the retaining features 74 may include a surface 76 that contacts the shoulder 70 of the ball plunger 56, and in particular the contact surface 72 of the shoulder 70. The surface 76 may be oriented generally perpendicular to the actuation axis A-A. However, the surface 76 may be positioned other angles relative to the actuation axis A-A as well. Because the retaining features 74 contact the bottom contact surface 72 of the ball plunger 56, relative movement between the rocker arm 30 and the actuation member 36 may be selectively limited in the downward direction D, away from the rocker arm 30. Therefore, the ball plunger 56 may be securely positioned between the recess 54 and the retaining features 74 of the receiving portion 52, creating a retention assembly between the rocker arm 30 and the actuation member 36.

Moreover, because the retaining features 74 are positioned equidistant from another, the pressure the shoulder 70 exerts on the surface 76 may be generally uniform. In one illustration the surface 76 of the retaining feature 74 may be generally parallel with the shoulder 70 of the ball plunger 56 as well in an effort to distribute pressure evenly along the retaining features 74. However, the surface 76 or the shoulder 70 may also be angled as well, as long as there is contact between the surface 76 and the shoulder 70 during operation of the valve train assembly 20. In particular, the surface 76 of the retaining member 74 should at least partially limit relative movement between the rocker arm 30 and the actuation member 36.

Including the retaining features 74 with the rocker arm 30 may be advantageous, especially in a cylinder deactivation type of valve train system. This is because in a cylinder deactivation type valve train, the rocker arm 30 should be able to transmit a force sufficient to suppress the radial movement of the cam 32 from translating to the valve 34. In other words, the actuation member 36 should be able to suppress movement along the actuation axis A-A such that the valve 34 can not be actuated during cylinder deactivation. In this situation, the rocker arm 30 may transmit forces that are generally greater than forces typically experienced in a non-deactivation type of valve train. As a result, the retaining features 74 may be designed to withstand the increased forces that are experienced on deactivation type valve train systems. In contrast, at least some other retaining devices available to retain the rocker arm 30 to the actuation member 36 may not be able to withstand the increased forces typically experienced on a deactivation type valve train.

Another advantage of including the retaining features 74 with the rocker arm 30 is illustrated in FIG. 3. FIG. 3 illustrates the rocker arm 30 and the ball plunger 56, where the ball plunger 56 is free to rotate about the actuation axis A-A inside of the receiving portion 52 of the rocker arm 30. That is, the ball plunger 56 is free to rotate inside the receiving portion 52 while still being secured to the rocker arm 30. More particularly, the ball plunger may rotate in a counterclockwise direction R and a clockwise direction R' about the actuation axis A-A. In contrast, at least some other retaining devices available may restrict the rotation about the actuation axis A-A, and thereby reduce the degree of relative movement between the generally hemispherical surface of the recess 54 and the outer surface 58 of the ball plunger 56 (seen in FIG. 1). The rocker arm 30 may also include a cut 80 located along a side 82 of the rocker arm 30. In particular, the cut 80 may be located around at least a portion of the receiving portion 52, where the cut 80 may be for facilitating assembly of the actuation member 36 inside the receiving portion 52. The cut 80 may be located along the front end 84 of the rocker arm 30, where the cut 80 may include a generally arcuate profile.

Figure 5:
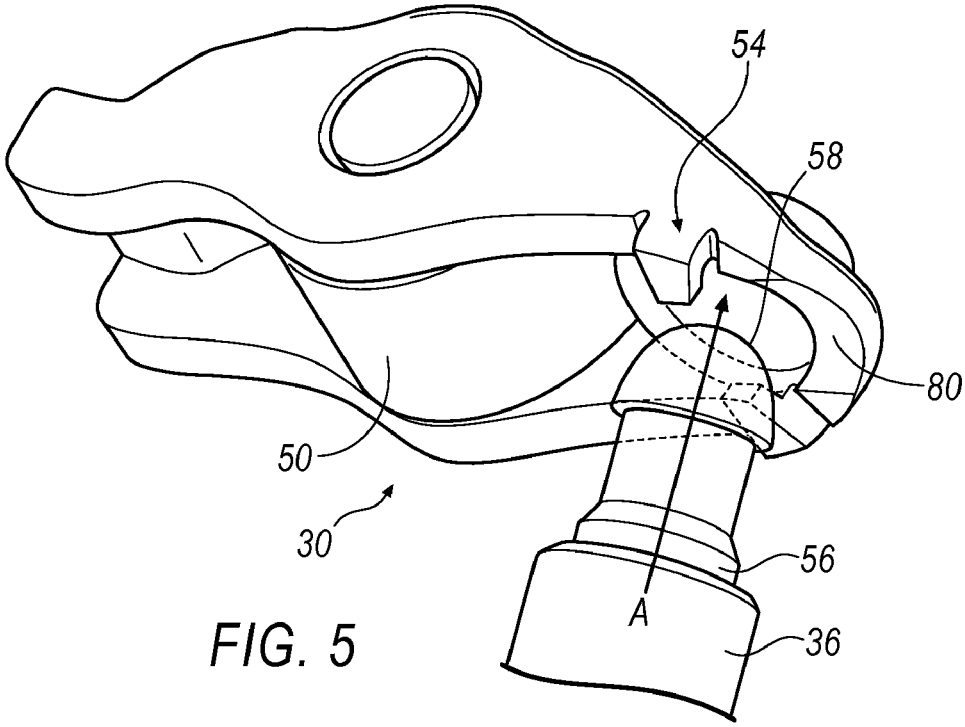
FIG. 5 is an elevational view of the underside of the rocker arm assembly, where the ball plunger of the hydraulic lash adjuster is assembled to the rocker arm.

Turning to FIG. 5, the inner portion 50 of the rocker arm 30 is illustrated and the actuation member 36 selectively engages with the recess 54 of the rocker arm 30 during assembly. As the actuation member 36 is assembled to the rocker arm 30, the ball plunger 56 may be positioned in an angular direction A such that the outer surface 58 of the ball plunger 56 slides within a space created by the retaining features 74 of the rocker arm 30, sized to avoid an undesirable interference between the shoulder 70 of the ball plunger 56 and the rocker arm 30, before entering the recess 54. In the illustration of FIG. 5, the ball plunger 56 enters the recess 54 at the angle A during assembly, and then may be rotated within the recess 54 to be aligned with the actuation axis A-A (as seen in FIGS. 1-3).

Figure 6:
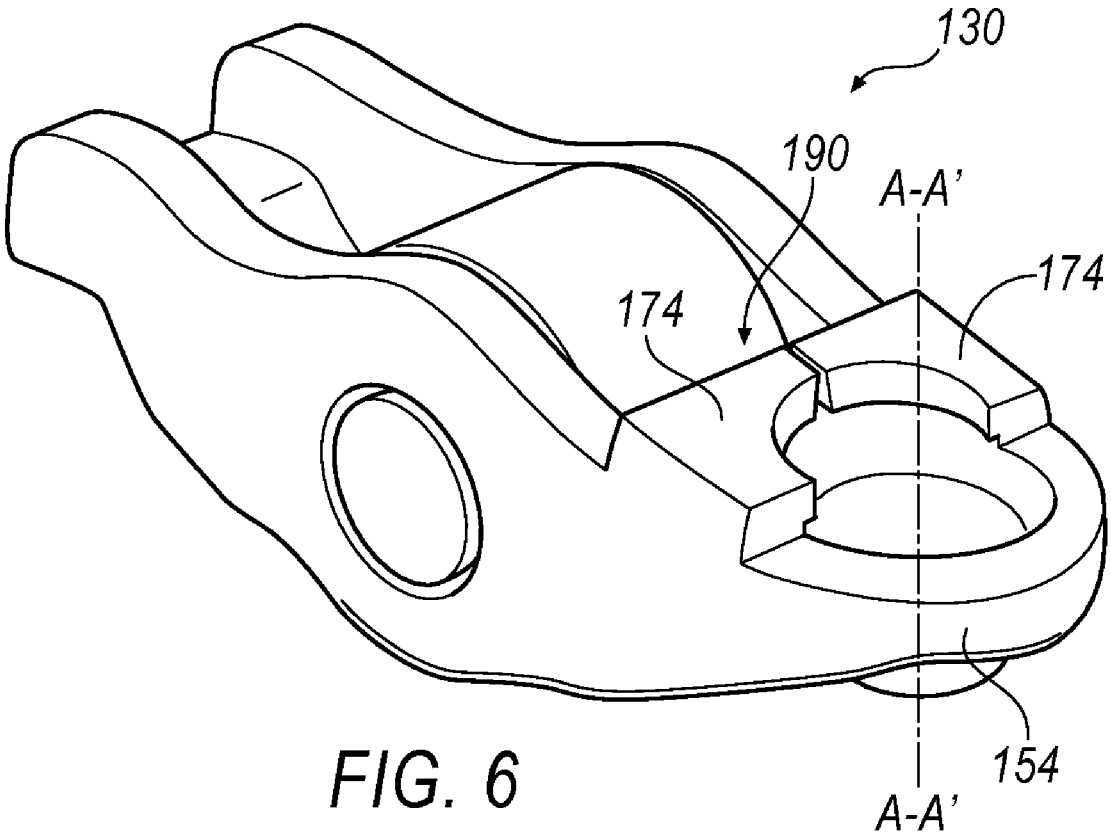
FIG. 6 is an alternative design illustration of the rocker arm in FIG. 4.

FIG. 6 is an alternative illustration of the rocker 130, similar to the view as seen in FIG. 4. The rocker arm 130 may include the two side retaining features 174 positioned towards a back side 190 of the recess 154. In contrast, the rocker arm 30 of FIG. 4 illustrates the retaining features 74 positioned on generally opposing sides of the recess 54. Turning back to FIG. 6, the rocker arm 130 may not need to include a cut along the side of the recess 154 (similar to the cut 80 illustrated in FIGS. 3-5). This is because positioning the retaining features 174 along the back side 190 may allow for enough clearance inside of the recess 154 to fit the ball plunger 56 (as seen in FIGS. 1-3) to the rocker arm 130 during assembly, and therefore no cut may be needed to facilitate assembly. However, the retaining features 174 may extend into the recess 154 further than the retaining features 74 as seen in FIG. 4. That is, the retaining features 174 as illustrated in FIG. 6 may extend further towards the actuation axis A-A' than the retaining features 74 as seen in FIG. 4. As a result, a ball plunger assembled to the rocker arm 130 in FIG. 5 may need to include a deeper shoulder cut into the outer surface when compared to the ball plunger 56 as seen in FIGS. 1-3. Including a deeper cut along the shoulder 70 of the ball plunger 56 may decrease the stiffness of the ball plunger 56. Therefore, the rocker arm 130 may not be used in at least some types of applications where the ball plunger 56 may require increased stiffness.

The present disclosure has been particularly shown and described with reference to the foregoing illustrations, which are merely illustrative of the best modes for carrying out the disclosure. It should be understood by those skilled in the art that various alternatives to the illustrations of the disclosure described herein may be employed in practicing the disclosure without departing from the spirit and scope of the disclosure as defined in the following claims. It is intended that the following claims define the scope of the disclosure and that the method and apparatus within the scope of these claims and their equivalents be covered thereby. This description of the disclosure should be understood to include all novel and non-obvious combinations of elements described herein, and claims may be presented in this or a later application to any novel and non-obvious combination of these elements. Moreover, the foregoing illustrations are illustrative, and no single feature or element is essential to all possible combinations that may be claimed in this or a later application.

What is claimed is:

1. A reciprocating lever for a valve train assembly, comprising:

a receiving portion; and at least one retaining feature located at the receiving portion of the reciprocating lever, the at least one retaining feature configured to selectively engage with and limit relative movement of an adjusting member with respect to the reciprocating lever along an actuation axis;

wherein the at least one retaining feature is created integrally with the reciprocating lever as part of a stamping process.

2. The reciprocating lever as recited in claim 1, further comprising an actuation direction defined by the actuation axis, the actuation direction defining a direction wherein the reciprocating lever selectively actuates the adjusting member, wherein the receiving portion selectively receiving the adjusting member that is actuated by the reciprocating lever, and wherein the at least one retaining feature projects radially inwardly towards the actuation axis.

3. The reciprocating lever as recited in claim 1, wherein the at least one retaining feature comprises two tabs located on generally opposing sides of the receiving portion.

4. The reciprocating lever as recited in claim 3, wherein the two tabs include an engagement surface that is generally perpendicular to the actuation axis.

5. The reciprocating lever as recited in claim 2, further comprising a recess located in the receiving portion for receiving the adjusting member that is actuated by the reciprocating lever.

6. The reciprocating lever as recited in claim 1, wherein the reciprocating lever further includes a cut located around at least a portion of the receiving portion, the cut facilitating assembly of the adjusting member inside the receiving portion.

7. The reciprocating lever as recited in claim 1, wherein the adjusting member is selectively engaged between an active and an inactive position, such that when in the inactive position a force exerted along an actuation axis is absorbed by the adjusting member and cannot be translated to a valve positioned at a second end of the reciprocating lever.

8. The reciprocating lever as recited in claim 1, wherein the at least one retaining feature is monolithic and is at least one of created with the rocker arm as part of a stamping process, or created as at least one separate piece that is added to the rocker arm by a joining process, wherein the joining process is at least one of welding and bonding.

9. A retention assembly, comprising:

a first adjusting member including a shoulder;

a rocker arm including an actuation direction; and at least one retaining feature located at the rocker arm, the at least one retaining feature in selective engagement with the shoulder of the first adjusting member;

wherein the at least one retaining feature selectively limits relative movement along the actuation direction between the first adjusting member and the rocker arm;

wherein the relative movement is measured as the at least one retaining feature is actuated in a downward direction away from the rocker arm;

wherein the at least one retaining feature is created integrally with the rocking arm as part of a stamping process.

10. The retention assembly as recited in claim 9, wherein the first adjusting member is a hydraulic lash adjuster.

11. The retention assembly as recited in claim 10, wherein the hydraulic lash adjuster includes a ball plunger of a hydraulic lash adjuster, and the ball plunger includes the shoulder.

12. The retention assembly as recited in claim 9, wherein the at least one retaining feature projects radially inwardly towards an actuation axis, which defines the actuation direction that the rocker arm actuates the first adjusting member.

13. The retention assembly as recited in claim 9, wherein the at least one retaining feature comprises two tabs located on generally opposing sides of the receiving portion.

14. The retention assembly as recited in claim 13, wherein the two tabs include an engagement surface that is generally perpendicular to an actuation axis.

15. The retention assembly as recited in claim 9, wherein the at least one integral retaining feature comprises two tabs located at a back side of the receiving portion.

16. The retention assembly as recited in claim 9, further comprising a recess located along a surface of the rocker arm for receiving the first adjusting member.

17. The retention assembly as recited in claim 16, wherein the rocker arm further includes a cut located around at least a portion of the recess, the cut facilitating assembly of the adjusting member inside the recess.

18. A retention assembly for a valve train system, comprising:

a hydraulic lash adjuster including a shoulder;

a rocker arm, the rocker arm including an actuation direction defining a direction that the rocker arm actuates the hydraulic lash adjuster; and at least one retaining feature including a retaining surface, the at least one retaining feature located at the rocker arm and engaging with the shoulder of the hydraulic lash adjuster at the retaining surface;

wherein the at least one retaining surface selectively limits relative movement along the actuation direction between the shoulder of the hydraulic lash adjuster and the rocker arm; and wherein the relative movement is measured as the hydraulic lash adjuster is selectively actuated in a first direction;

wherein the at least one retaining feature is created integrally with the rocking arm as part of a stamping process.

19. The retention assembly as recited in claim 18, wherein the at least one retaining feature projects radially inwardly towards an actuation axis.

20. The retention assembly as recited in claim 18, wherein the at least one retaining feature comprises two tabs located on generally opposing sides of the receiving portion, and wherein the two tabs include the retaining surface that is generally perpendicular to an actuation axis.

21. The retention assembly as recited in claim 18, further comprising a recess located along a surface of the rocker arm for receiving the hydraulic lash adjuster.

* * * * *